US007730942B2

(12) United States Patent
Gramme et al.

(10) Patent No.: US 7,730,942 B2
(45) Date of Patent: Jun. 8, 2010

(54) METHOD AND EQUIPMENT FOR THE REDUCTION OF MULTIPLE DISPERSIONS

(75) Inventors: Per Eivind Gramme, Porsgrunn (NO); Gunnar Hannibal Lie, Porsgrunn (NO)

(73) Assignee: Norsk Hydro ASA, Oslo (NO)

( * ) Notice: Subject to any disclaimer, the term of this patent is extended or adjusted under 35 U.S.C. 154(b) by 126 days.

(21) Appl. No.: 11/884,045

(22) PCT Filed: Feb. 10, 2006

(86) PCT No.: PCT/NO2006/000056

§ 371 (c)(1),
(2), (4) Date: Jan. 25, 2008

(87) PCT Pub. No.: WO2006/085775

PCT Pub. Date: Aug. 17, 2006

(65) Prior Publication Data

US 2009/0126927 A1 May 21, 2009

(30) Foreign Application Priority Data

Feb. 11, 2005 (NO) ..... 20050767

(51) Int. Cl.
*E21B 43/12* (2006.01)
*E21B 43/34* (2006.01)

(52) U.S. Cl. ..... 166/245; 166/52; 166/313

(58) Field of Classification Search ..... None
See application file for complete search history.

(56) References Cited

U.S. PATENT DOCUMENTS 4,844,817 A 7/1989 Flanigan et al.

(Continued)

FOREIGN PATENT DOCUMENTS

CA 1330055 6/1989

(Continued)

OTHER PUBLICATIONS

Patent Cooperation Treaty (PCT) International Preliminary Report on Patentability, International Application No. PCT/NO2006/00056, date of completion May 15, 2007.

(Continued)

*Primary Examiner*—Zakiya W. Bates
(74) *Attorney, Agent, or Firm*—Wenderoth, Lind & Ponack, L.L.P.

(57) ABSTRACT

A method and equipment for reducing or avoiding multiple dispersions in fluid flows each having two or more non-mixable fluid components with different specific gravities and viscosities, in particular fluid flows of oil, gas and water from different oil/gas production wells (B1-B8) in formations beneath the surface of the earth or sea. The fluid flow from each well (B1-B8), depending on whether it is oil-continuous (o/w) or water-continuous (w/o), is fed to a transport pipeline (T) so that the oil-continuous fluid flows (o/w) are supplied to the transport line (T) first and the water-continuous fluid flows (w/o) second, or the two fluid flows (o/w, w/o) are fed to two separate transport lines (T1, T2). In a preferred embodiment, the two separate transport lines (T1, T2) may be connected to a common transport line (T); the two fluid flows (o/w, w/o) are mixed before further transport and any subsequent separation in a separator. In another preferred embodiment, each of the fluid flows in the respective transport lines (T1, T2) may be fed to a common separator (H) or its own independent separator.

9 Claims, 8 Drawing Sheets

U.S. PATENT DOCUMENTS

| | | | |
|---|---|---|---|
| 5,762,149 | A | 6/1998 | Donovan et al. |
| 6,277,286 | B1 | 8/2001 | Søntvedt et al. |
| 2005/0006086 | A1 | 1/2005 | Gramme |

FOREIGN PATENT DOCUMENTS

| | | |
|---|---|---|
| SU | 855335 | 2/1979 |
| WO | 03/033872 | 4/2003 |
| WO | 03/033875 | 4/2003 |

OTHER PUBLICATIONS

Russian Examination Report (with English translation) issued Oct. 3, 2008 in corresponding Russian Application No. 2007133824.

G.S. Loutoshkin, "Gathering and Treatment of Oil, Gas and Water", 2nd Edition, Moscow, Nedra, 1979 (with English translation).

Canadian Examination Report mailed Nov. 6, 2009 in corresponding Canadian Application No. 2,597,469.

a)
Single dispersion
b)
Multiple dispersion (drops in drops)
c)
Complex multiple dispersion (drops in drops in drops)
Mixing of oil and water continuous wells results in multiple dispersions
a)
b)
c)
Well 1
Well 2
Well 3

METHOD AND EQUIPMENT FOR THE REDUCTION OF MULTIPLE DISPERSIONS

BACKGROUND OF THE INVENTION

The present invention concerns a method and equipment for reducing or eliminating multiple dispersions in fluid flows each consisting of two or more fluid components with different specific gravities and viscosities, in particular fluid flows of oil and water from different oil/gas production wells in formations beneath the surface of the earth or sea.

All production wells will have different contents of water in oil, so-called water-cut, which develop differently over time. If several oil-continuous and/or water-continuous wells are mixed together, multiple dispersions will be created, i.e. dispersions in which drops are dispersed inside other drops, creating several drop layers outside each other. If several oil-continuous and water-continuous wells are mixed together, very complex dispersions may be created with many drop layers that will be very difficult, if not impossible, to separate.

SUMMARY OF THE INVENTION

The present invention represents a method and equipment that aim to reduce or eliminate the creation of such complex dispersions with several drop layers (several drops inside each other).

BRIEF DESCRIPTION OF THE DRAWINGS

The present invention will be described in further detail by means of examples and with reference to the attached drawings, where.

DETAILED DESCRIPTION OF THE INVENTION

As stated above, all production wells for oil/gas will have different contents of water in oil, so-called water-cut, which develop differently over time. In a flow of oil and water in a production pipe from a well, situations may, therefore, occur in which there is more water than oil, i.e. a water-continuous flow, or in which there is more oil than water, i.e. an oil-continuous flow. The inventors of the present invention have found that if several oil-continuous and/or water-continuous wells are mixed together, multiple dispersions will be created, i.e. dispersions In which drops are dispersed inside other drops, creating several drop layers outside each other. If several oil-continuous and water-continuous wells are mixed together, very complex dispersions may be created with many drop layers that may be very difficult to separate.

Figure 1:
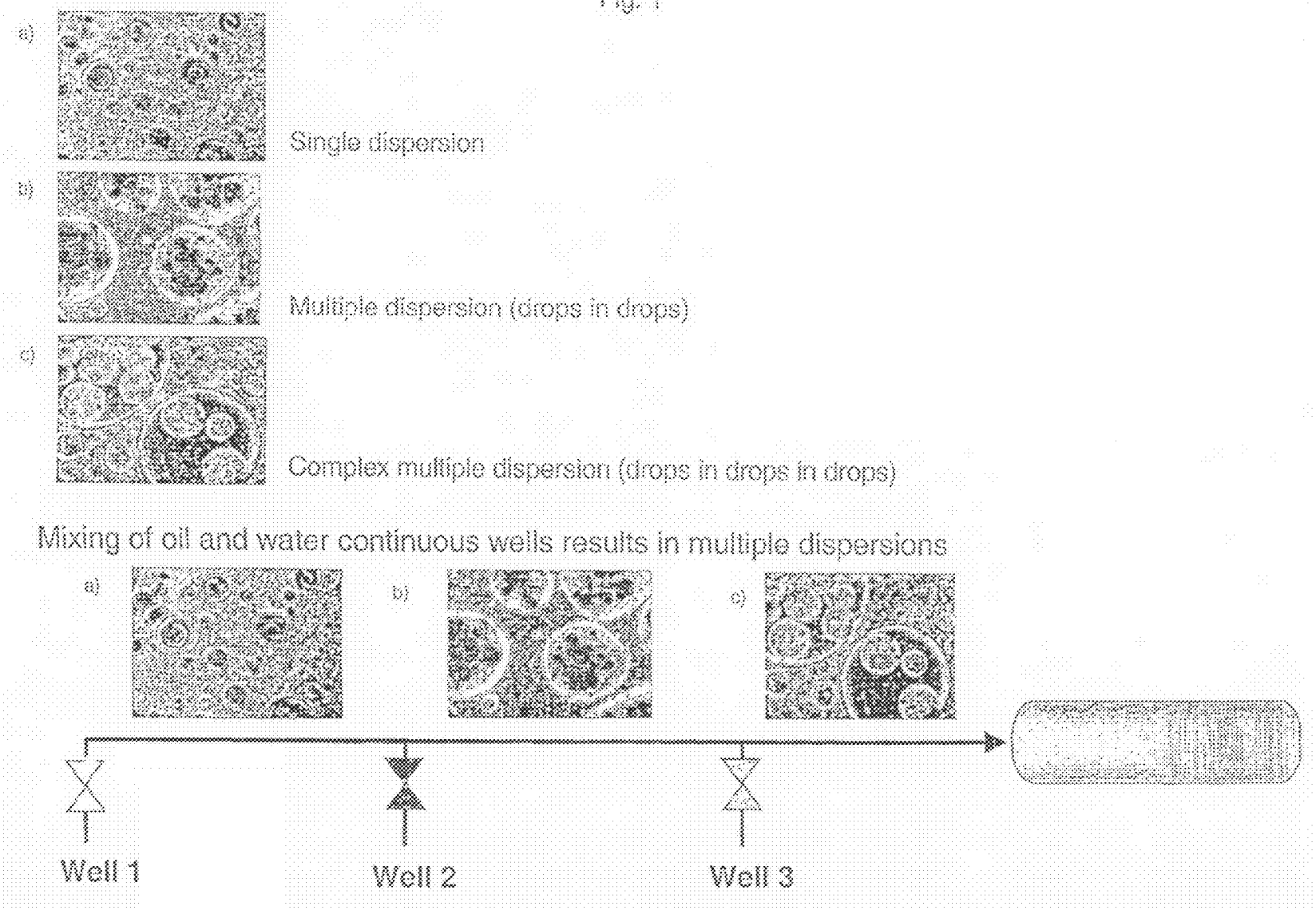
FIG. 1 shows pictures of dispersions of oil and water; picture a) shows a single dispersion, b) shows a multiple dispersion and c) shows a complex multiple dispersion (drop in drop in drop)

FIG. 1 shows examples of dispersions of water in oil; picture a) shows a single dispersion, picture b) shows a multiple dispersion (drops in drops) and c) shows a complex multiple dispersion (drops in drops in drops).

The number of changes in phase continuity when wells are mixed, for example in a manifold as illustrated in FIG. 1 at the bottom, determines the number of drop layers. The more inlets from well changes (wells 1, 2, 3), the more drop layers.

Figure 2:
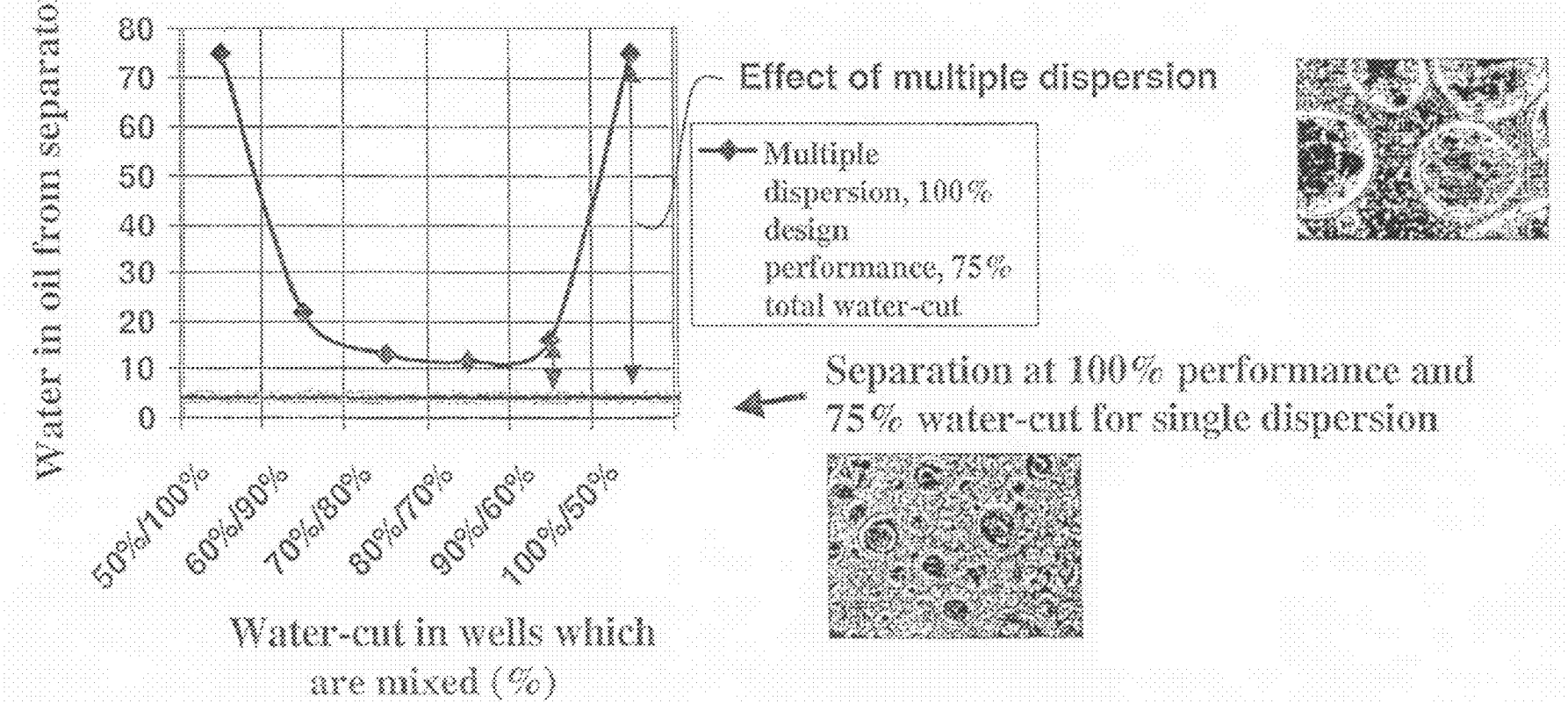
FIG. 2 shows a diagram that illustrates the effect of multiple dispersions when two fluid flows with different contents of water in oil/oil in water are mixed.

Tests have shown that multiple dispersions are much more difficult to separate than single dispersions. The diagram in FIG. 2 shows this, where the vertical axis shows water-cut from a separator in % compared with water-cut for two different wells with different percentage mixing. As the diagram shows, the number of multiple dispersions increases with the increase in difference in water-cut between the two wells, and the increase is exponential from 90/60% to 50/100%.

It is usually impossible to destabilize multiple dispersions using emulsion breakers (chemicals). The main reason is that the emulsion breaker can only be mixed into the outer continuous phase. The inner drop phases are, therefore, inaccessible to the emulsion breaker.

The main idea of the present, invention is to obtain a method that makes it possible to minimize or eliminate alternate mixtures of flows with opposite phase continuity (oil-continuous or water-continuous). The result will be the fewest possible numbers of drop layers in the dispersion after the wells have been mixed or by avoiding mixture before separation of the fluid in question.

Figure 3:
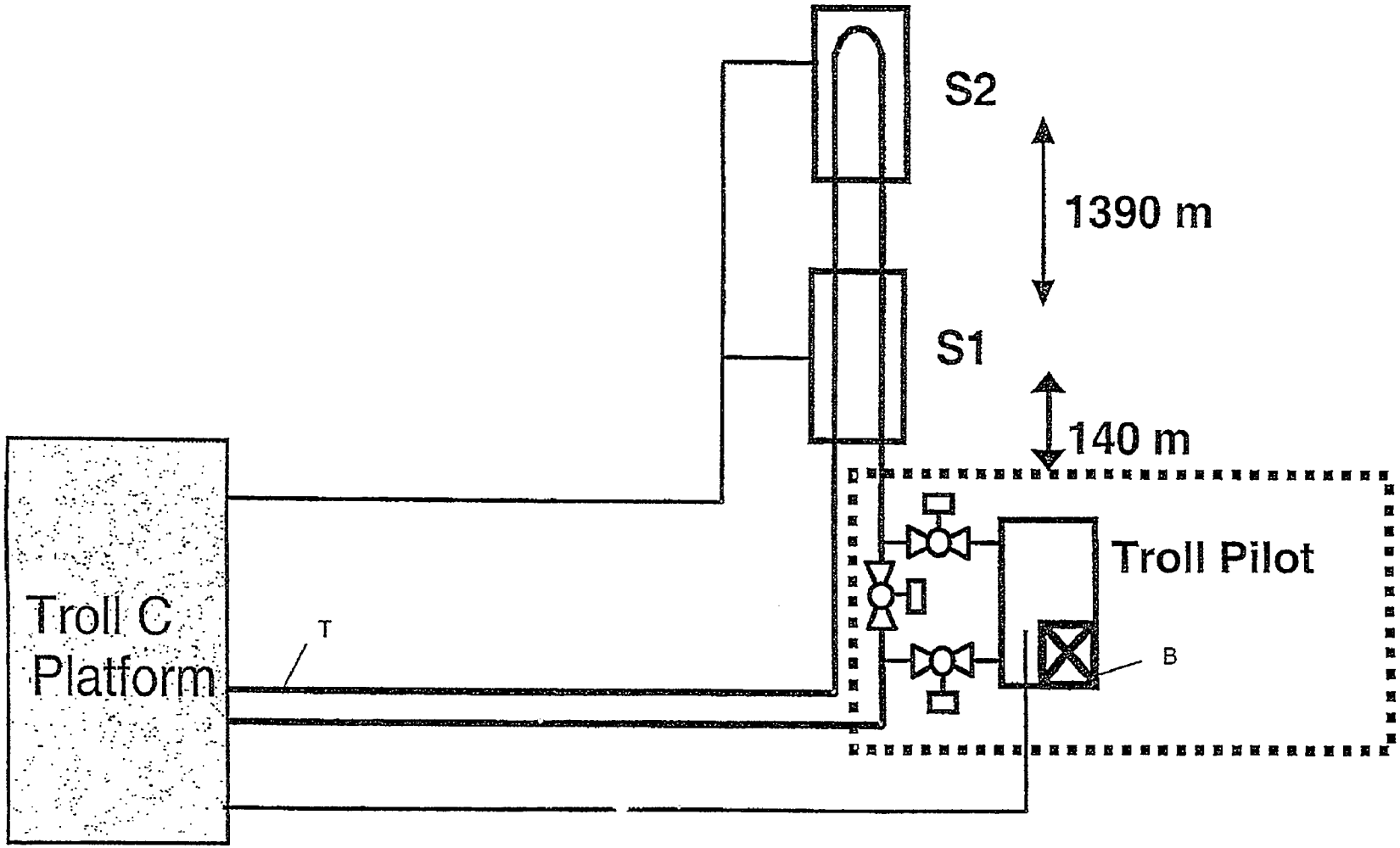
FIG. 3 shows a diagram of a well transport system for Troll C in the North Sea.

A typical well transport system with double pipelines that can be round-pigged is used in the North Sea in the Troll field (Troll Pilot) and is shown in further detail in FIG. 3. Oil is produced from wells in Troll Pilot and fed via equipment rigs (templates) S1, S2 on the seabed to the Troll C platform.

Figure 4A:
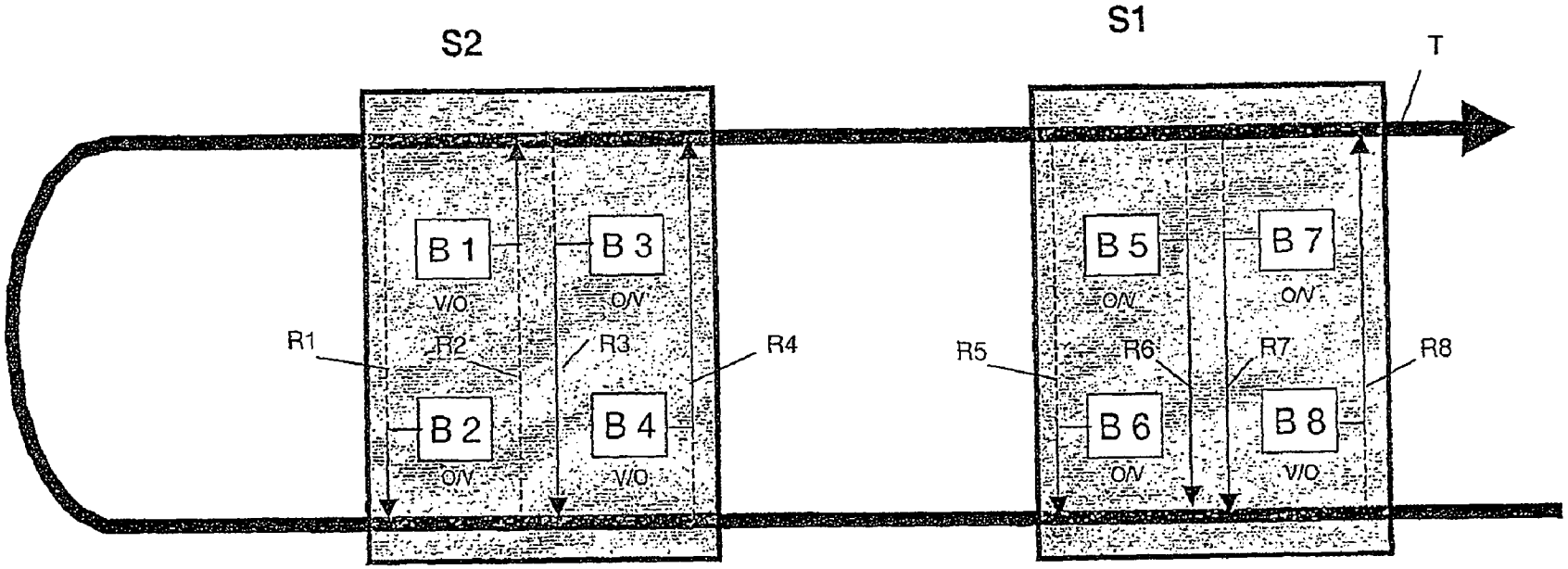
FIGS. 4*a-e* show diagrammatic examples of practical embodiments of the method and equipment in accordance with the present invention.

A practical embodiment of the idea based on the pipe system in FIG. 3 is shown in FIG. 4*a*.

In the example shown in FIG. 4*a*, all water-continuous flows, marked "w/o" in the figure, are mixed first, after which all oil-continuous flows, marked "o/w", are added. This is made possible by each well, B1-B8, depending on the water-cut situation for the oil/water flow from each of them, being fitted with a pipeline end manifold or branches R1-R8, which feed the oil/water flow from each of the wells to the transport pipeline, T, upstream or downstream in relation to it. FIG. 4*a* shows that a water-continuous well, w/o, for example B4, is supplied to pipe T downstream of it, while an oil-continuous well, o/w, for example B2, is supplied to pipe T upstream of it.

The system shown in FIG. 4*a* is considerably better than conventional manifolding of wells, in which the wells are mixed in a "random" order.

Figure 4B:
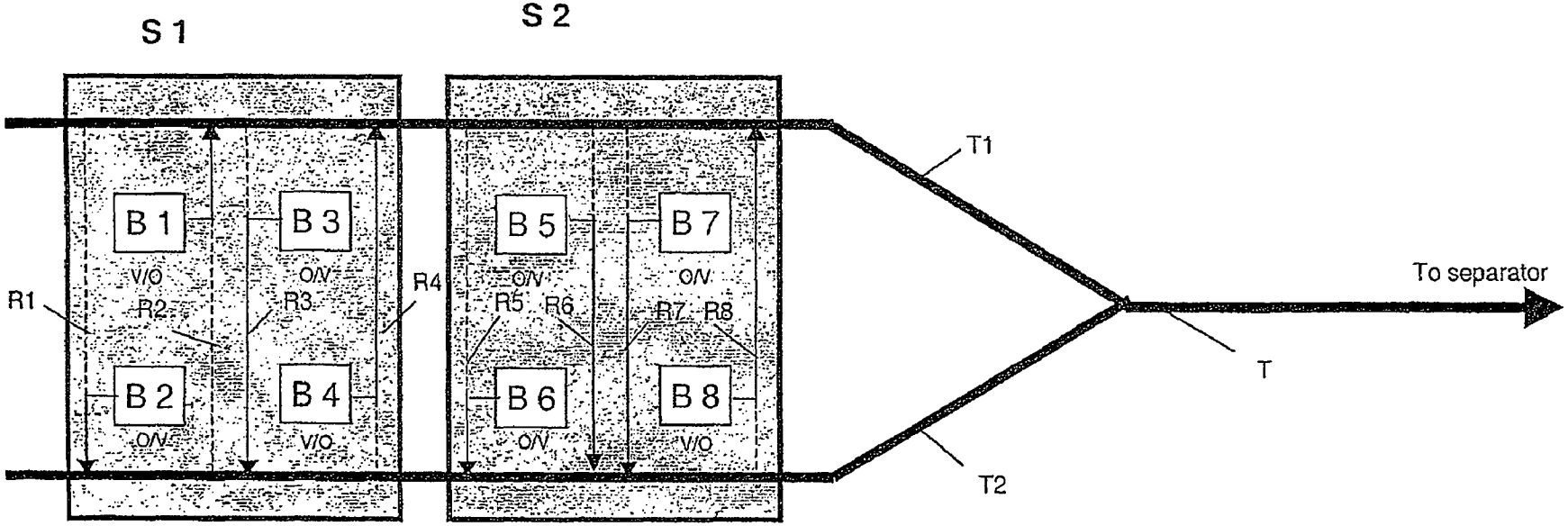

A system that is even better than the one shown in FIG. 4*a* is shown in FIG. 4*b*. All oil-continuous wells, o/m and all water-continuous wells, w/o, are collected here via pipeline branches R1-R8, each in its own transport pipeline T1, T2, which are combined to create a main transport line T and mixed before they reach the separator, H. This system has just one mixture of either oil-continuous or water-continuous flows.

Figure 4C:
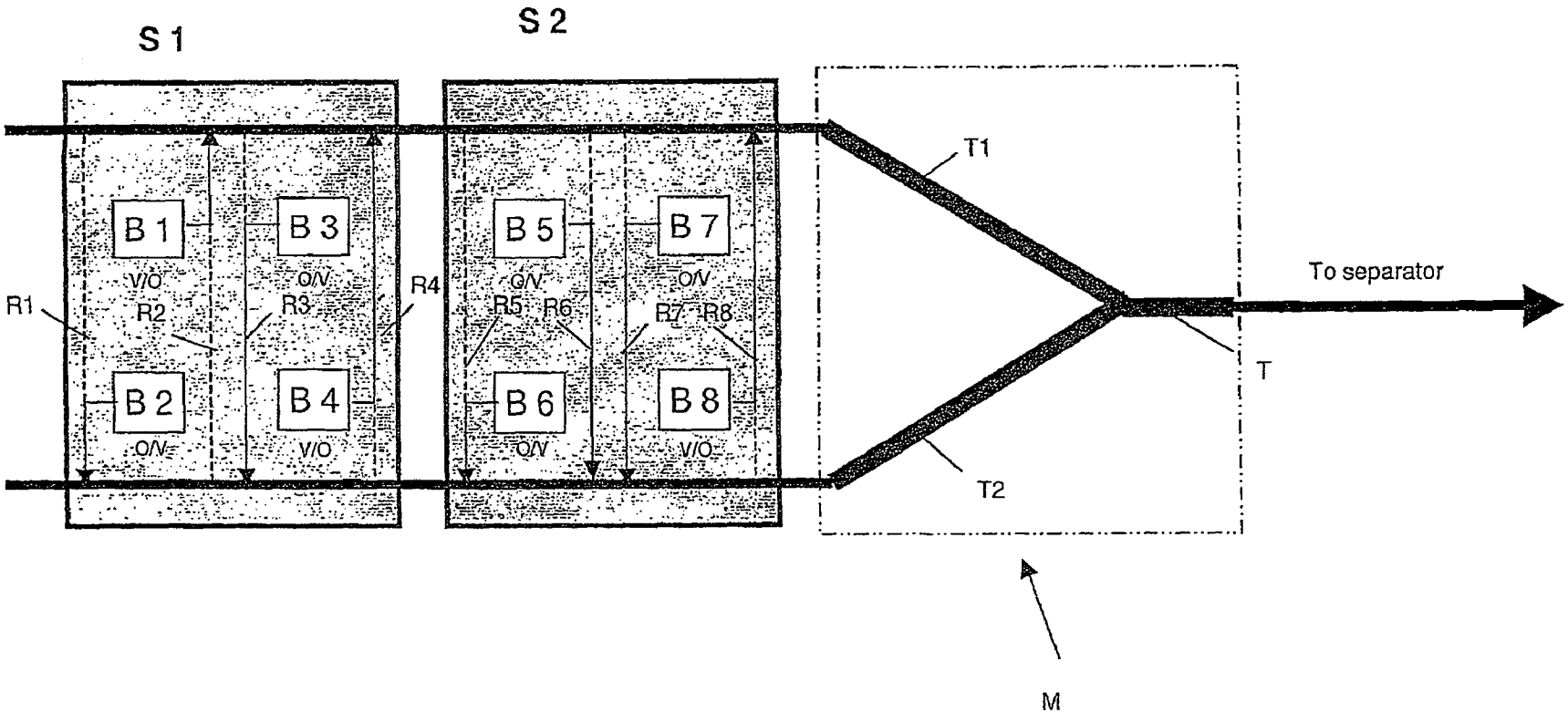

The system in FIG. 4*b* can be improved further by designing the pipes around the mixing point, M, with such a large diameter, see FIG. 4*c*, that the flow pattern in both the oil-continuous and water-continuous pipes is stratified. This considerably reduces the risk of the creation of multiple dispersions in the mixing point, as the oil phases and the water phases in each pipe are generally mixed separately.

Figure 4D:
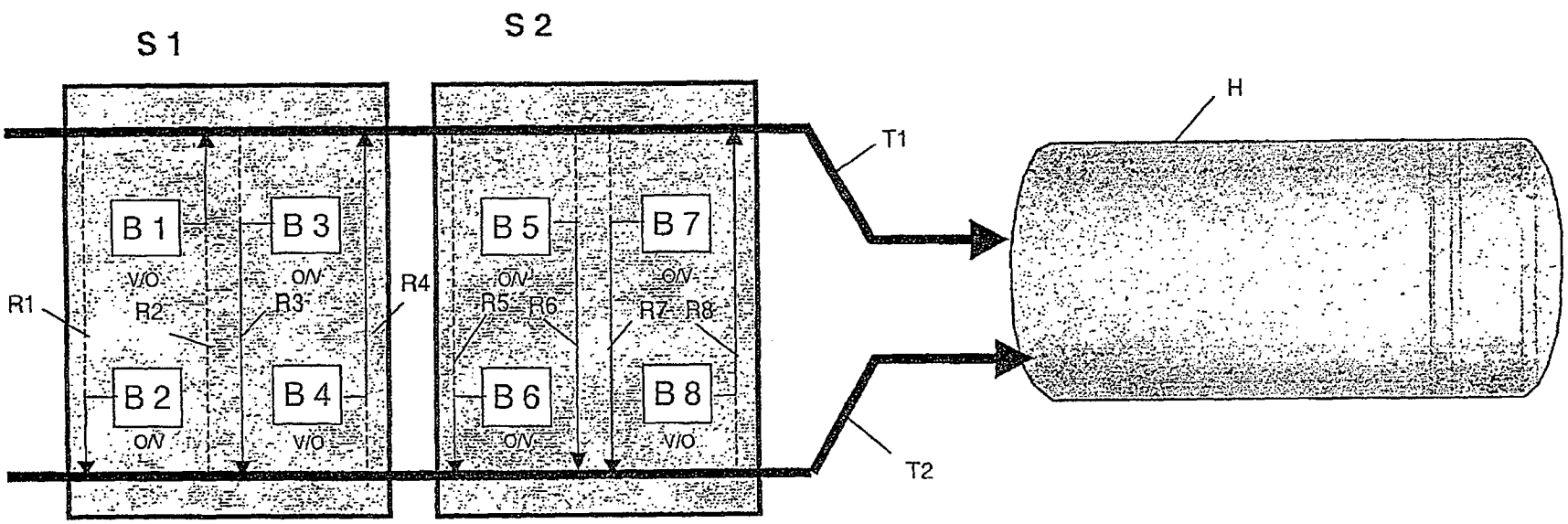

An alternative is to run both pipes (oil-continuous fluid and water-continuous fluid) separately up to the separator, where the oil-continuous fluid is mixed into the oil phase and the water-continuous fluid is mixed into the water phase. See FIG. 4*d*. A suitable inlet into the separator may, for example, comprise two cyclones, one for each flow, designed in such a way that the gas outlet lies in the gas phase, the water outlet from the "water-continuous cyclone" lies in the water phase and the oil outlet from the "oil-continuous cyclone" lies in the oil phase. This is a system that completely eliminates the problems of multiple dispersions.

Figure 4E:
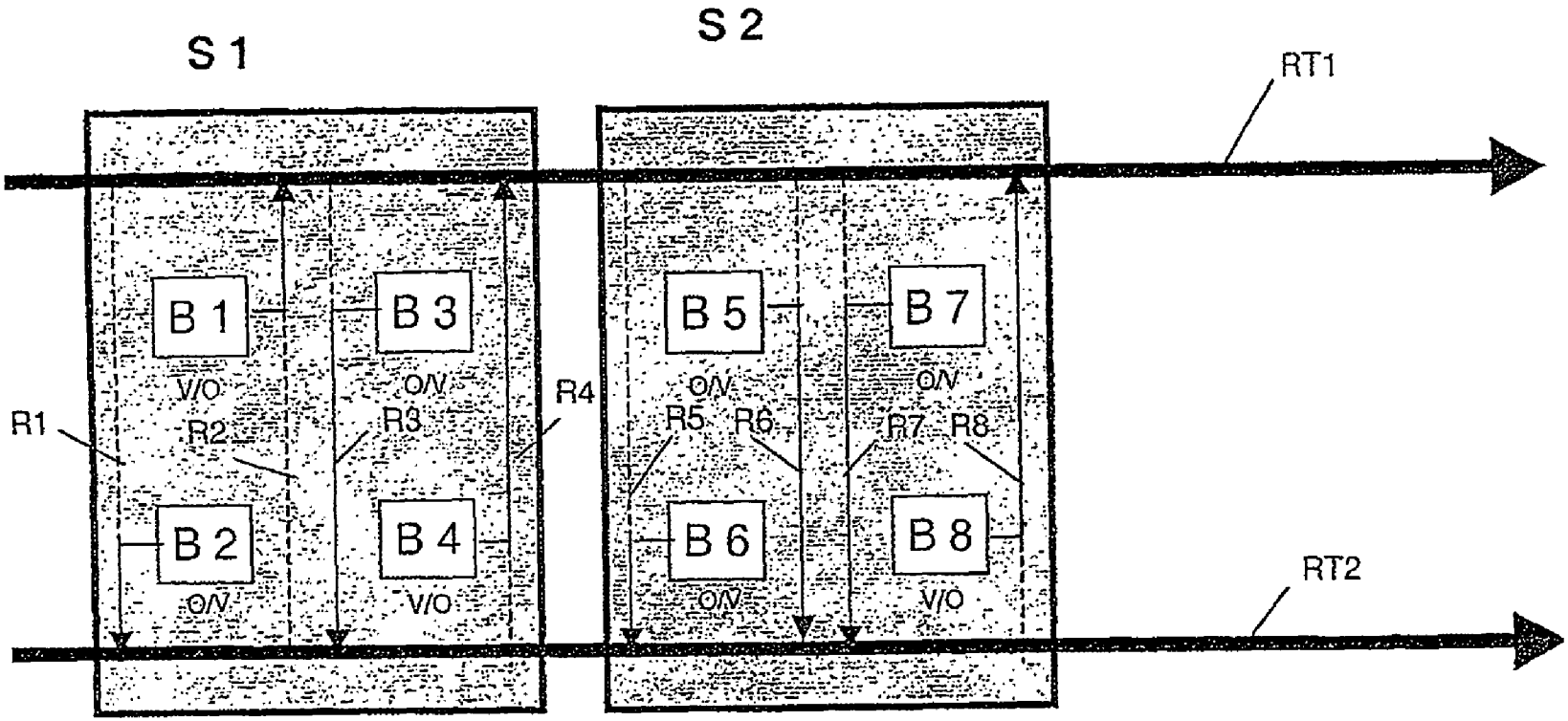

An equivalent system may involve using two pipe separators, one for the water-continuous flow, RT1, and one for the oil-continuous flow, RT2, as shown in FIG. 4*e*. This will also represent a system that completely eliminates the problems of multiple dispersions.

The invention claimed is:

1. A method for reducing or avoiding multiple dispersions in fluid flows each including two or more non-mixable fluid components with different specific gravities and viscosities, wherein the fluid flows comprise oil and water from different oil/gas production wells in formations beneath the surface of the earth or sea, the method comprising:

feeding the fluid flow from each well to a transport pipeline so that the oil-continuous fluid flows are supplied to the transport pipeline upstream of the water-continuous fluid flows; or feeding the oil-continuous fluid flows to a first transport line and the water-continuous flows to a second transport line, wherein the first and second transport lines are connected to a common separator.

2. A method as claimed in claim 1, wherein the first and second transport lines are connected to the common separator via a common transport line.

3. A method as claimed in claim 2, wherein each of the first and second transport lines and the common transport line have an extended diameter in an area at a connection point of the lines in order to achieve stratified flow for the fluid flows in this area.

4. A method as claimed in claim 1, wherein the method further comprises feeding the fluid flows from the first and second transport lines to a separator via a common transport line.

5. A method as claimed in claim 1, wherein the method further comprises feeding the fluid flows from the first and second transport lines directly to a separator.

6. Equipment for reducing or avoiding multiple dispersions in fluid flows each including two or more non-mixable fluid components with different specific gravities and viscosities, wherein the fluid flows comprise oil and water from different oil/gas production wells in formations beneath the surface of the earth or sea, the equipment comprising:

a transport pipeline;

a first plurality of pipeline branches connected to the transport pipeline so oil-continuous fluid flows from the wells are fed to the transport pipeline; and a second plurality of pipeline branches connected to the transport pipeline so water-continuous fluid flows from the wells are fed to the transport pipeline, wherein the pipeline branches are disposed such that the oil-continuous fluid flows are supplied to the transport line upstream of the water-continuous fluid flows.

7. Equipment for reducing or avoiding multiple dispersions in fluid flows each includes two or more non-mixable fluid components with different specific gravities and viscosities, wherein the fluid flows comprise oil and water from different oil/gas production wells in formations beneath the surface of the earth or sea, the equipment comprising:

a first transport line;

a second transport line;

a plurality of pipeline branches connected to the first transport line so that the oil-continuous flows from the wells are fed to the first transport line; and a plurality of pipeline branches connected to the second transport line so that water-continuous flows from the wells are fed to the second transport line, wherein the first and second transport lines are connected to a common separator.

8. Equipment as claimed in claim 7, wherein the first and second transport lines are connected to the common separator via a common transport line.

9. Equipment as claimed in claim 8, wherein each of the first and second transport lines and the common transport line have an extended diameter in an area at a connection point of the first and second transport lines in order to achieve stratified flow for the fluid flows in this area.

* * * * *